US005224046A

United States Patent [19]

Kim et al.

[11] Patent Number: 5,224,046

[45] Date of Patent: Jun. 29, 1993

[54] SYSTEM FOR RECHARGING A PLURALITY OF POSTAGE METERS

[75] Inventors: Hyung-Kun P. Kim, Wilton; Barry H. Axelrod, Trumbull; Eric L. Zuidema, Norwalk, all of Conn.

[73] Assignee: Pitney Bowes Inc., Stamford, Conn.

[21] Appl. No.: 893,966

[22] Filed: Jun. 4, 1992

Related U.S. Application Data

[63] Continuation of Ser. No. 582,047, Sep. 13, 1990, abandoned.

[51] Int. Cl.[5] ..... G07B 17/04

[52] U.S. Cl. ..... 364/464.02; 235/375

[58] Field of Search ..... 235/375, 380, 382, 382.5; 364/464.02, 464.03; 902/5, 41

[56] References Cited

U.S. PATENT DOCUMENTS

| | | | |
|---|---|---|---|
| 3,792,446 | 2/1974 | McFiggins et al. | 364/900 |
| 4,097,923 | 6/1978 | Eckert, Jr. et al. | 364/900 |
| 4,122,532 | 10/1978 | Dlugos et al. | 364/900 |
| 4,138,735 | 2/1979 | Alocca et al. | 364/900 |
| 4,447,890 | 5/1984 | Duwel et al. | 364/900 |
| 4,498,187 | 2/1985 | Soderberg et al. | 364/464.03 X |
| 4,752,950 | 6/1988 | Le Carpentier | 364/464.02 X |
| 4,807,139 | 2/1989 | Liechti | 364/464.02 |
| 4,811,234 | 3/1989 | Storace | 364/464.02 |
| 4,812,992 | 3/1989 | Storace et al. | 364/464.02 |
| 4,837,701 | 6/1989 | Sansone et al. | 364/464.03 |
| 4,853,864 | 8/1989 | Hart et al. | 364/464.03 X |
| 4,908,770 | 3/1990 | Breault et al. | 235/382.5 X |
| 4,978,839 | 12/1990 | Chen et al. | 235/375 |
| 5,077,660 | 12/1991 | Haines et al. | 364/464.02 |

FOREIGN PATENT DOCUMENTS

| | | |
|---|---|---|
| 0298776 | 1/1989 | European Pat. Off. . |
| 2636852 | 2/1978 | Fed. Rep. of Germany . |
| 2584516 | 6/1985 | France . |
| 2080202 | 2/1982 | United Kingdom . |
| 2147853 | 5/1985 | United Kingdom . |
| 2185443 | 7/1987 | United Kingdom . |

*Primary Examiner*—Edward R. Cosimano
*Attorney, Agent, or Firm*—Robert H. Whisker; Melvin J. Scolnick

[57] ABSTRACT

A system for obtaining recharge codes for one or more postage meters. The system includes a conventional microcomputer; including a keyboard and display, and disk drive, which is connected through a modem to a remote data processing center. The center provides codes which may be used to recharge postage meters, i.e., reset the meters so that they may continue printing postage. The system includes a data bank of information relating to each of the postage meters, including identification codes for each of the meters. A user enters information, including a control sum, for each meter and the system combines it with other information stored in the data bank to form messages. The system then enters into transactions with the remote data processing center to obtain recharge codes for each of the meters, which are then displayed for entry into the meters. In another embodiment the system may communicate directly with each meter through a local communications network.

5 Claims, 16 Drawing Sheets

SYSTEM FOR RECHARGING A PLURALITY OF POSTAGE METERS

This application is a continuation of application Ser. No. 07/582,047, filed Sep. 13, 1990 now abandoned.

BACKGROUND OF THE INVENTION

The subject invention relates to a system for obtaining recharge codes for one or more postage meters. More particularly, it relates to a system for automatically obtaining a recharge code for one or more meters selected from a plurality of postage meters. The subject invention further relates to embodiments which retransmit recharge codes to such selected meters so that such selected meters are automatically recharged.

Postage meters are devices which have found wide application in many businesses. Such meters are used to frank parcels and mail by printing indicia which are equivalent to postage stamps. Clearly, it is therefore essential that postage meters include a secure mechanism to assure that the meter prints only postage for which the postal service has been paid. Equally clearly, the secure mechanism must allow the postage meter to be recharged (or reset) with additional funds. That is, a mechanism must be provided which will allow the postage meter to print additional postage if and only if an equivalent amount has been paid to the postal service.

(Those skilled in the art will recognize that other forms of value, e.g. tax stamps, may be dispensed by postage meter-like devices. As used herein the term "postage meter" contemplates such devices which include a secure, rechargeable mechanism for controlled dispensing of value.)

Various schemes have been devised and implemented to obtain the desired remote recharging based on information from a remote data processing center. Typical systems are shown in U.S. Pat. No.: 3,792,446, to McFiggans et al, entitled REMOTE POSTAGE METER RESETTING METHOD: and in U.S. Pat. No.: 4,097,923, to Eckert, Jr. et al, entitled POSTAGE METER CHARGING SYSTEM USING AN ADVANCED MICROCOMPUTERIZED POSTAGE METER. These patents teach a data processing center which is equipped with a programmed digital computer and a voice answer-back unit to process telephone calls from users of postage meters equipped with either a combination lock such that the lock prohibits recharging of the associated meter until it is unlocked; or in the case of U.S. Pat. No.: 4,097,923, having a working memory which contains a seed number for generating postage funding combinations to unlock the meter. The remote system of the latter Patent includes the capability of adding variable amounts of postage to the meter. U.S. Pat. No.: 3,792,446, relates only to the addition of fixed increments to the meter. Each of these systems is based on transmission by a postage meter user of information including, or derived from, the contents of the meter ascending and descending registers, the meter serial number, and account number to be debited for the amount of funds to be recharged, and in the case of a variable recharge system, the amount by which the meter is to be recharged. If the data processing center includes a voice answer-back system the operator may transmit the information as DTMF tones over the telephone system or the operator may simply speak to a second operator at the data processing center to transmit the information. In either case the data processing center then provides an encrypted number which may be used to recharge the meter, as is described in the above referenced Patents.

As is well know to those skilled in the art the ascending register of a postage meter is a large capacity register which is incremented by the postage amount each time the meter prints an indicia, and thus contains the total amount of postage printed by the meter over its lifetime. The descending register is decremented by the amount of postage each time an indicia is printed and incremented by the amount of funds each time the meter is recharged. The meter, of course, cannot print postage in excess of the amount of funds in the descending register. The total of the ascending and the descending register is equal to the total amount of funds with which the meter has been charged in its lifetime. (Sometimes herein referred to as the control sum.) Since the recharge code is generated using a secure algorithm and is based on information which includes the control sum and the serial number of the meter, it is apparent that each recharge of the meter will require a secure, unique recharge code.

Such recharging systems are marketed by Pitney Bowes Inc, the assignee of the subject application, under the Trademark "Postage-by-Phone", and are described more fully in the above referenced Patents.

In the systems described above the recharge code is entered into a postage meter, such as the Pitney Bowes model 6900 Electronic Meter, manually through a keypad by an operator. Alternately, the information may be entered into the Model 6900 Meter through a communications port which is normally used for communication with a postal scale using a proprietary Pitney Bowes communications protocol described in U.S. Pat. No.: 4,498,187 to Soderborg et al.

U.S. Pat. No. 3,255,439, to Simjian discloses a system in which the meter communicates directly to a central accounting station for accounting for each and all of the meter operations, either on a real time basis or in batches. A similar system is disclosed in West German Patent Application No.: DE 2,636,852, published Feb. 23, 1978; in which a data transmitting unit is employed to recharge the postage meter over telephone or telegraph lines. British Patent Application No.: 2,147,853, published May 22, 1985, discloses a telephone integrated with a mail franking device, which operates either SA telephone or as a postage meter. The telephone keypad may be used to recharge funds and accounting may be done either locally at the device or in a central accounting unit.

Each of the above described devices requires a complex sequence of operations to recharge a postage meter. U.S. Pat. No.: 4,812,992, to Storace et al, issued Mar. 14, 1989, discloses a system which attempts to simplify the recharging process. In Pat. No.: 4,812,992, a novel postage meter which includes a dedicated communications port, which is preferable DTMF transmitter/receiver for telephone communications, is connected over the telephone network to a remote data processing center, such as a Pitney Bowes "Postage-by Phone" center. Each meter has the capability to initiate and complete a recharging transaction with the data processing center whenever its funds (i.e.,the contents of its descending register) fall below a preset limit.

While effective, the system of Pat. No.: 4,812,992, requires the design an implementation of a new meter and the approval of that meter by the U.S. Postal Service.

Thus it is an object of the subject invention to provide such a system which is compatible with existing postage meters without the necessity of obtaining approval from a postal service. It is a still further object of the subject invention to provide a system which is capable of obtaining a recharge code for a plurality of selected meters.

Other objects and advantages of the subject invention will be apparent to those skilled in the art from consideration of the attached drawings and of the detailed description set forth below.

BRIEF SUMMARY OF THE INVENTION

The above objects are achieved and the disadvantages of the prior art are overcome in accordance with the subject invention by means of a system for automatically obtaining a recharge code for a selected postage meter from a remote data processing center, where the data processing center transmits the recharge code to the system in response to a message from the system and debits the amount by which the selected meter is to be recharged to an account. The system includes a display, input apparatus for entry of data, communication apparatus for communicating with the remote data processing center, a memory for storing a data base of information relating to a plurality of postage meters, and control apparatus. The control apparatus controls the display to display names for each of the plurality of meters, and responds to data identifying one of the plurality of meters as the selected meter, which data is entered through the input apparatus, to access the data base to obtain recharge information relating to recharging the selected meter. The system further receives an access code for the selected meter and forms a message, the message including the meter recharge information and the access code for the selected meter. The control apparatus then transmits the message to the remote data processing center and receives the recharge code from the remote data processing center in response to the message.

In accordance with one aspect of the subject invention the recharge information includes a unique identification code for the selected meter.

In accordance with another aspect of the subject invention the recharge information includes an account number for an account against which the amount by which the selected meter is recharged is debited.

In accordance with another aspect of the subject invention the selected meter is connected to the system through a second communications apparatus and the system automatically transmits the recharge code to the selected meter.

In accordance with yet another aspect of the subject invention the system may obtain the access code from the selected meter through said second communications apparatus.

In accordance with still yet another aspect of the subject invention a plurality of postage meters is connected to such a system for obtaining a recharge code through a second communications means, the system including a data base of information for recharging the connected postage meters.

Thus it may be seen that the subject invention achieves the above objects and advantageously overcomes the problems of the prior art. Other objects and advantages of the subject invention will be apparent from consideration of the attached drawings and the description set forth below.

BRIEF DESCRIPTIONS OF THE DRAWINGS

Figure 1:
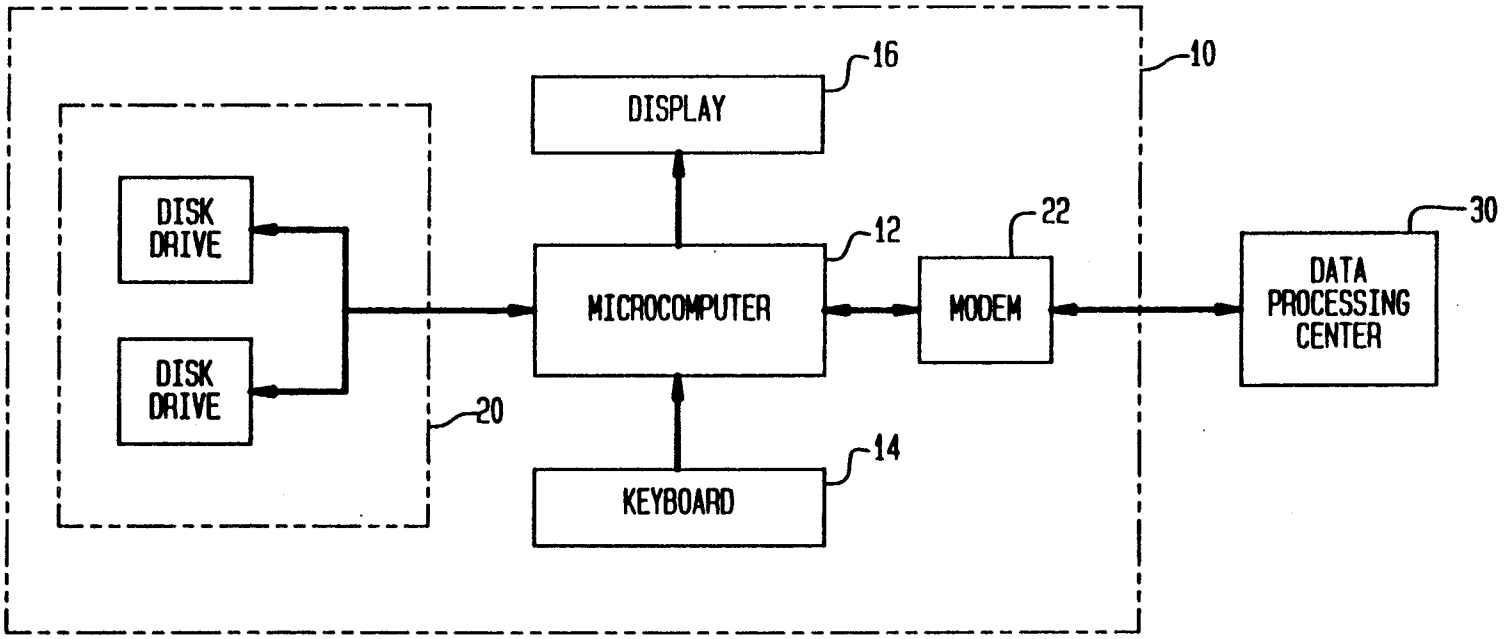
FIG. 1 shows a schematic block diagram of an embodiment of the subject invention.
Figure 2:
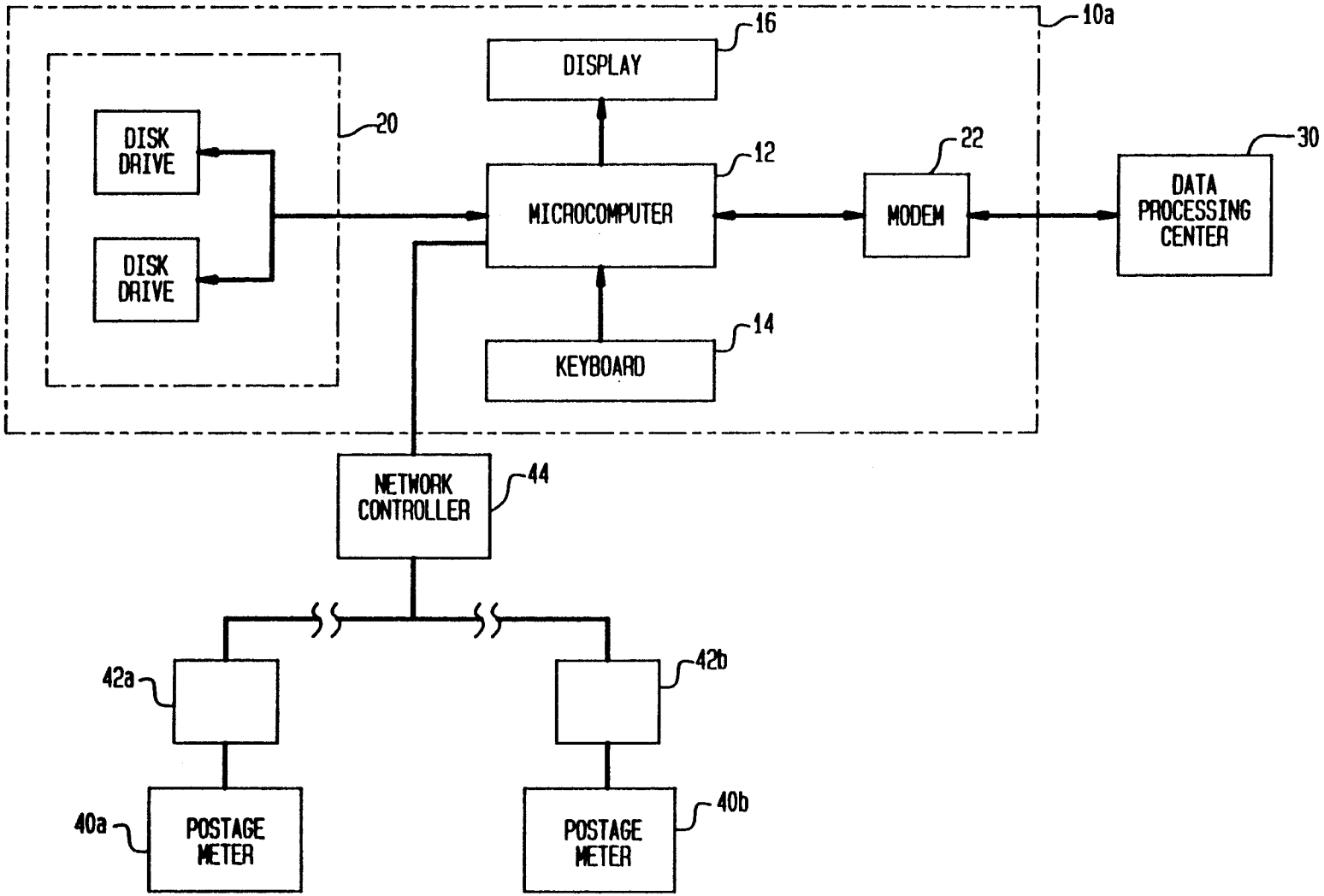
FIG. 2 shows a schematic block diagram of another embodiment of the subject invention wherein a plurality of postage meters are connected to a system in accordance with the subject invention.
Figure 3A:
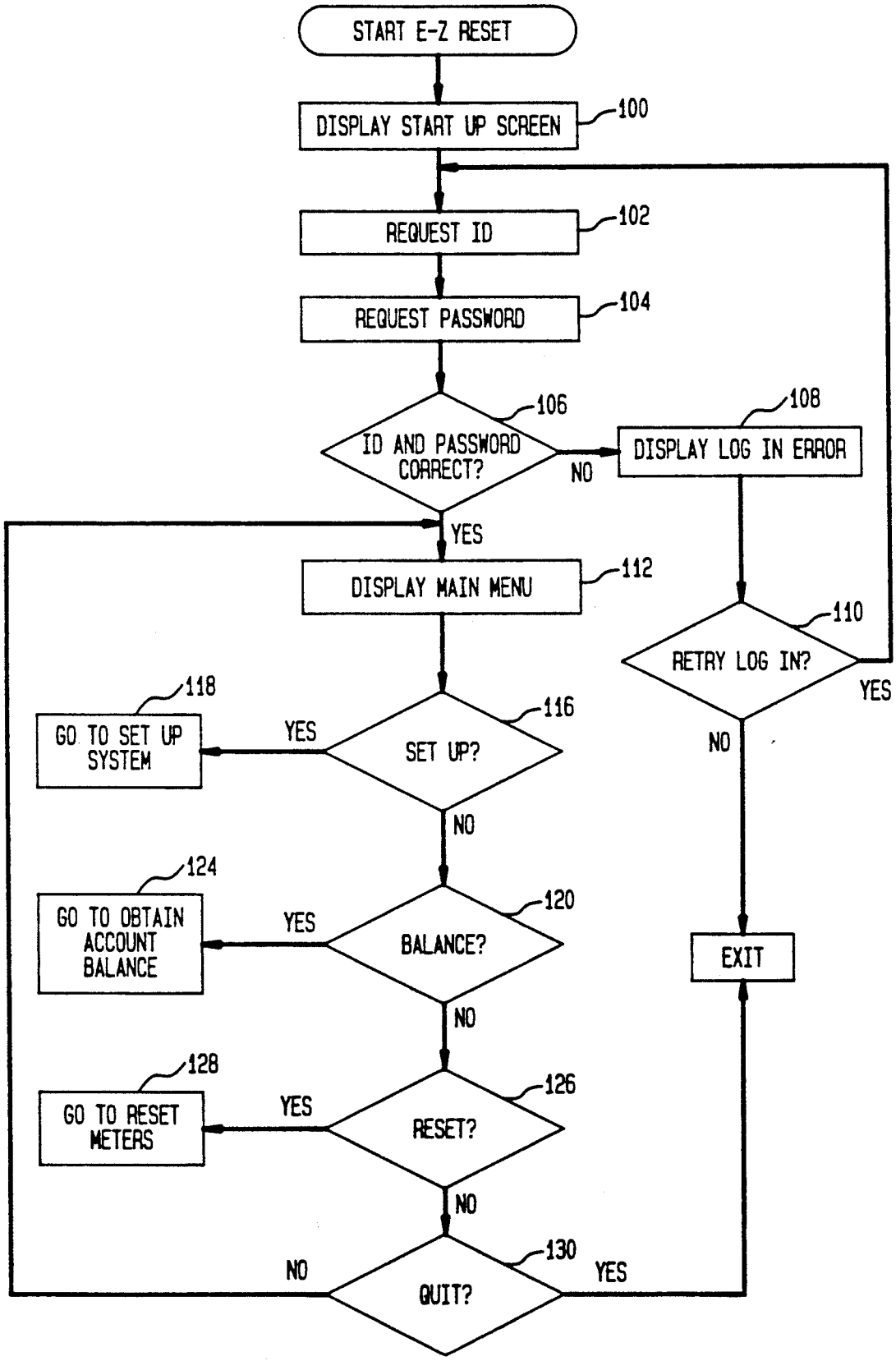
Figure 3B:
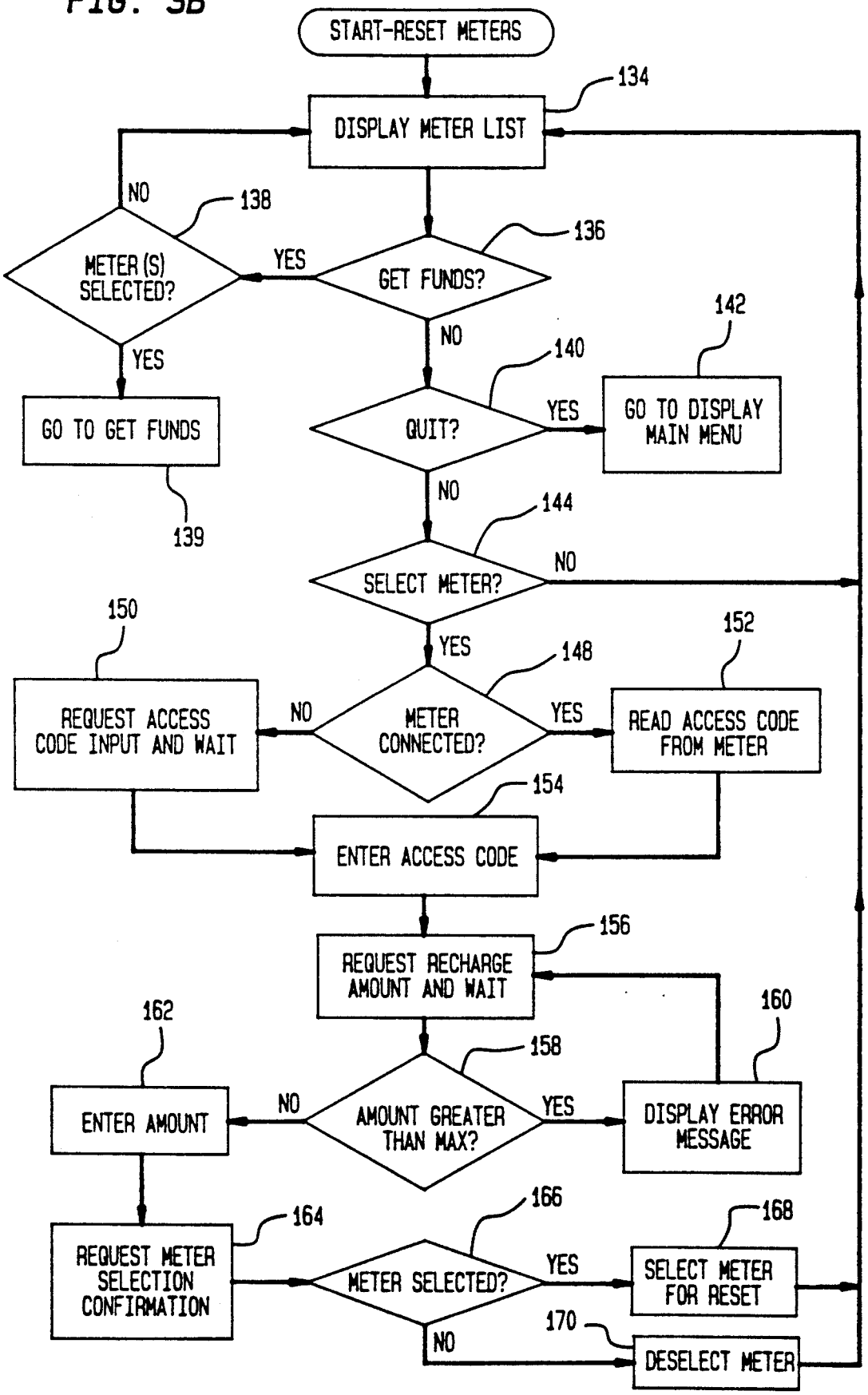
Figure 3C:
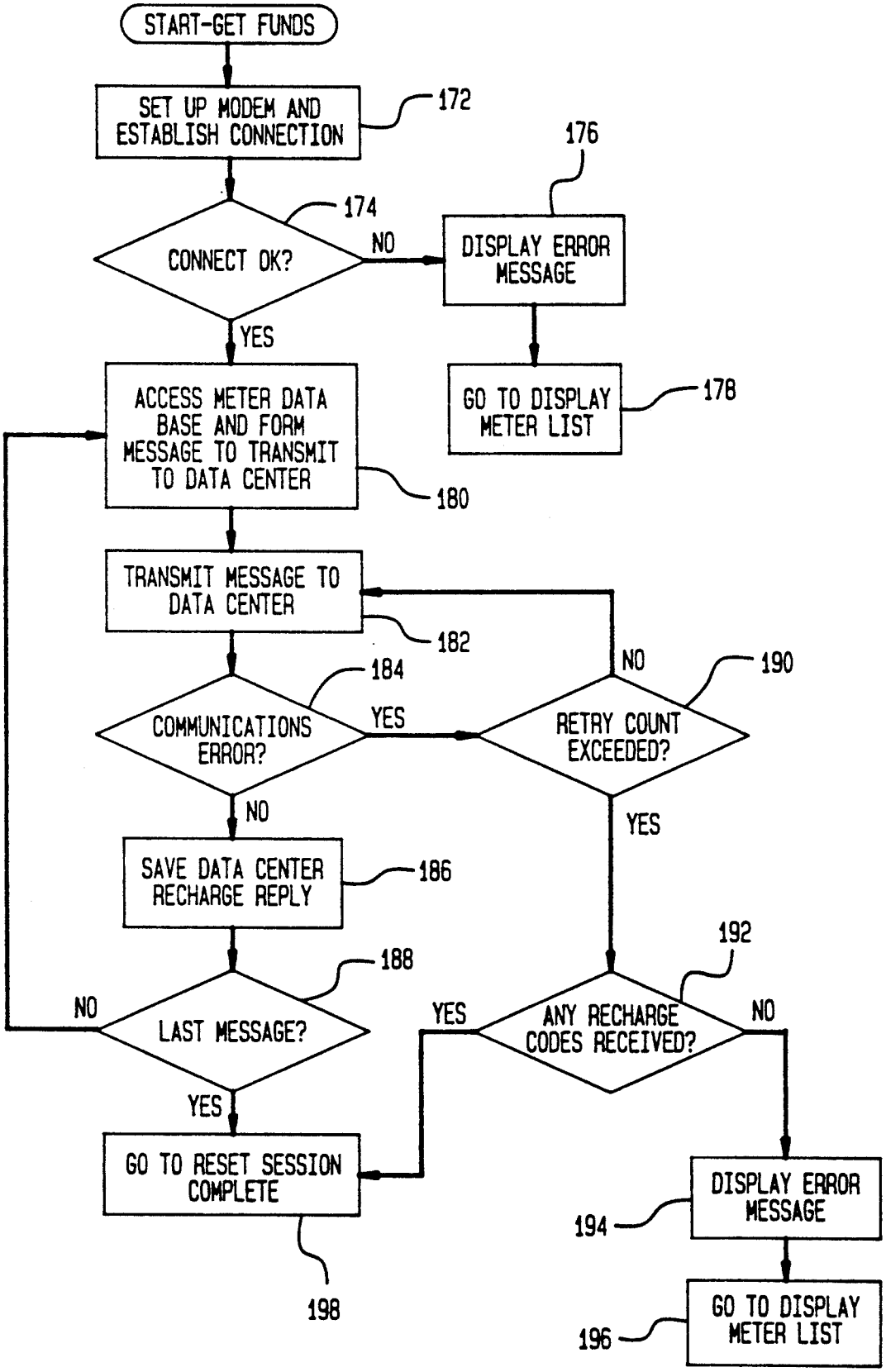
Figure 3D:
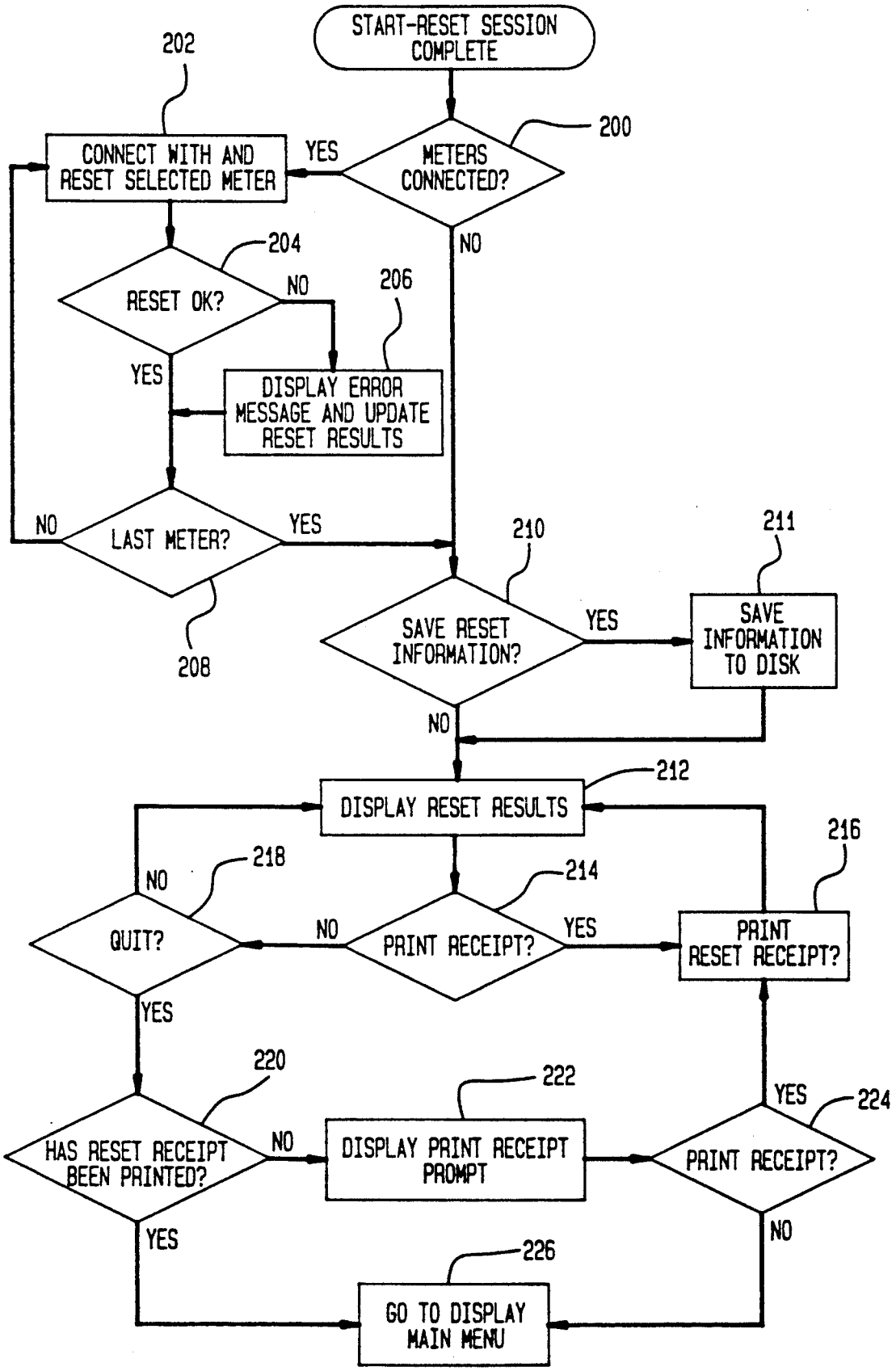
Figure 3E:
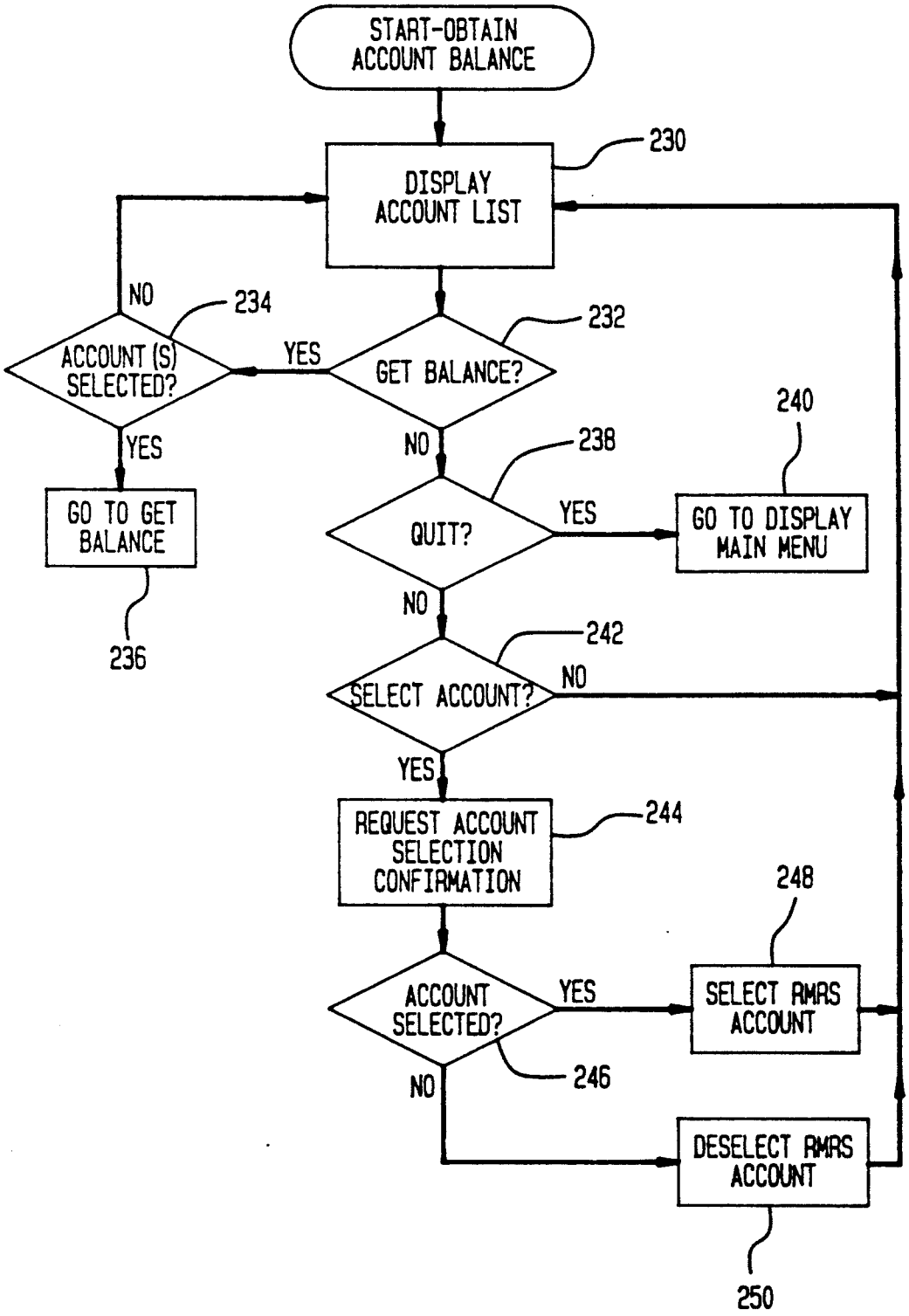
Figure 3F:
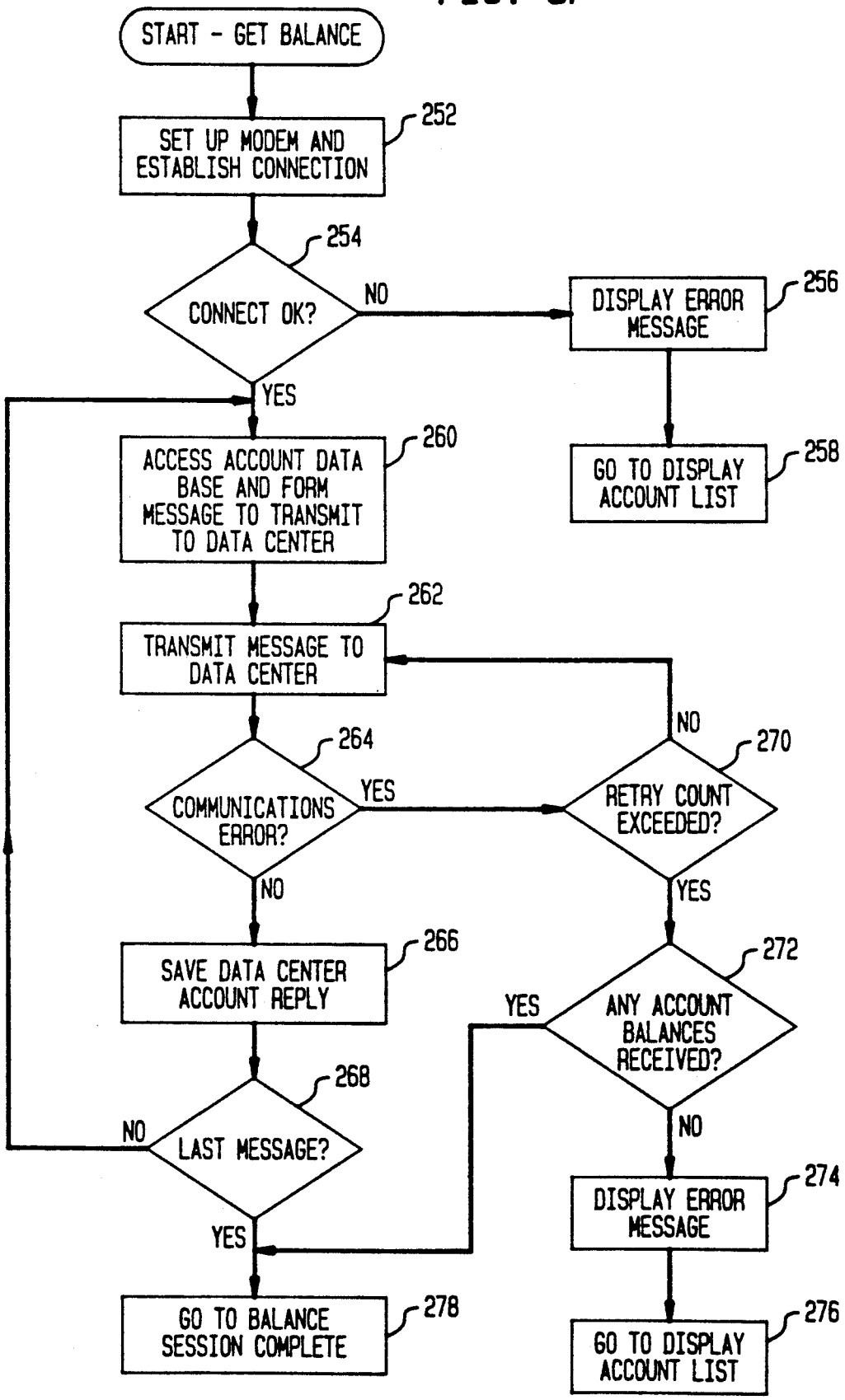
Figure 3G:
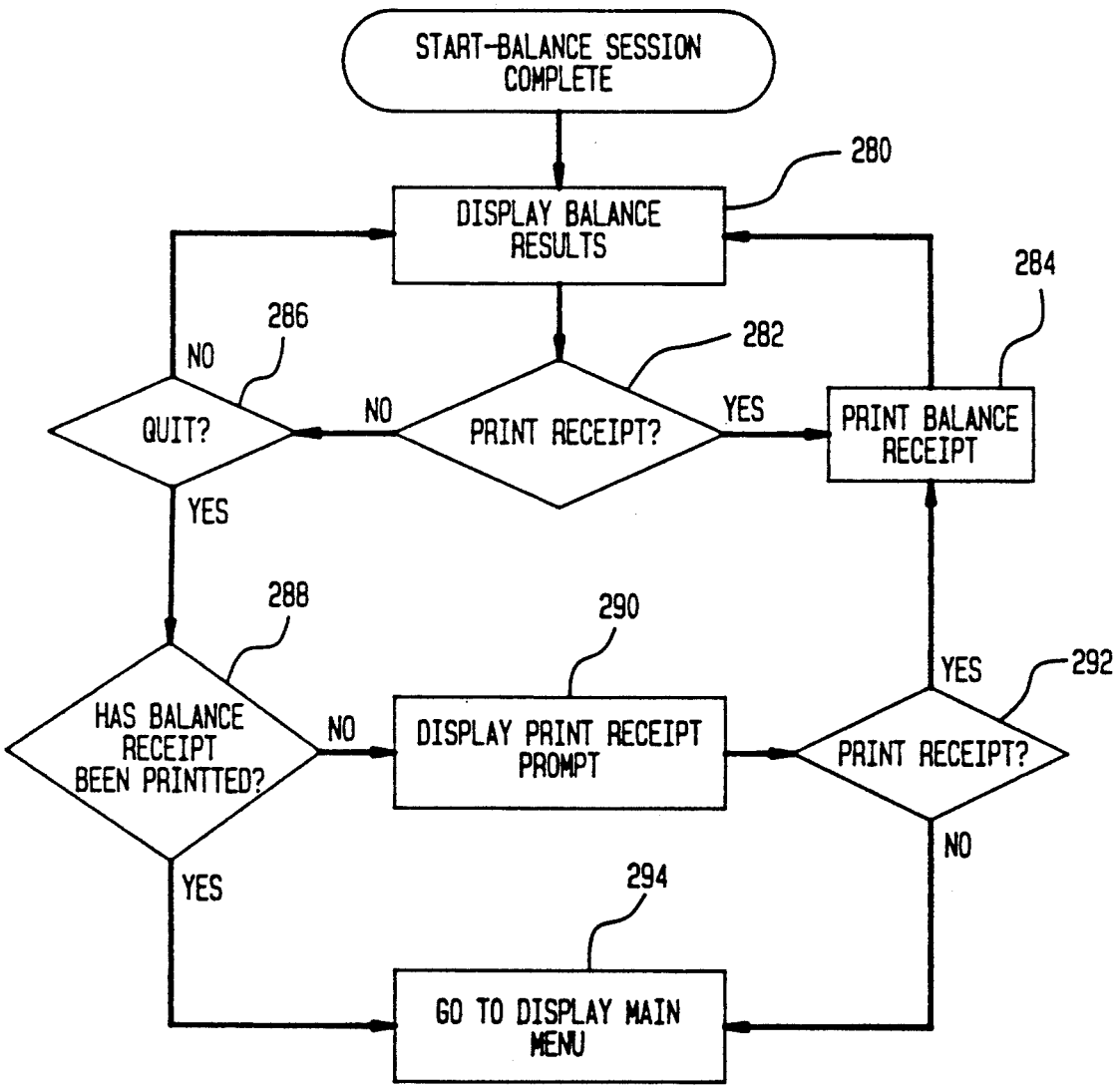
Figure 3H:
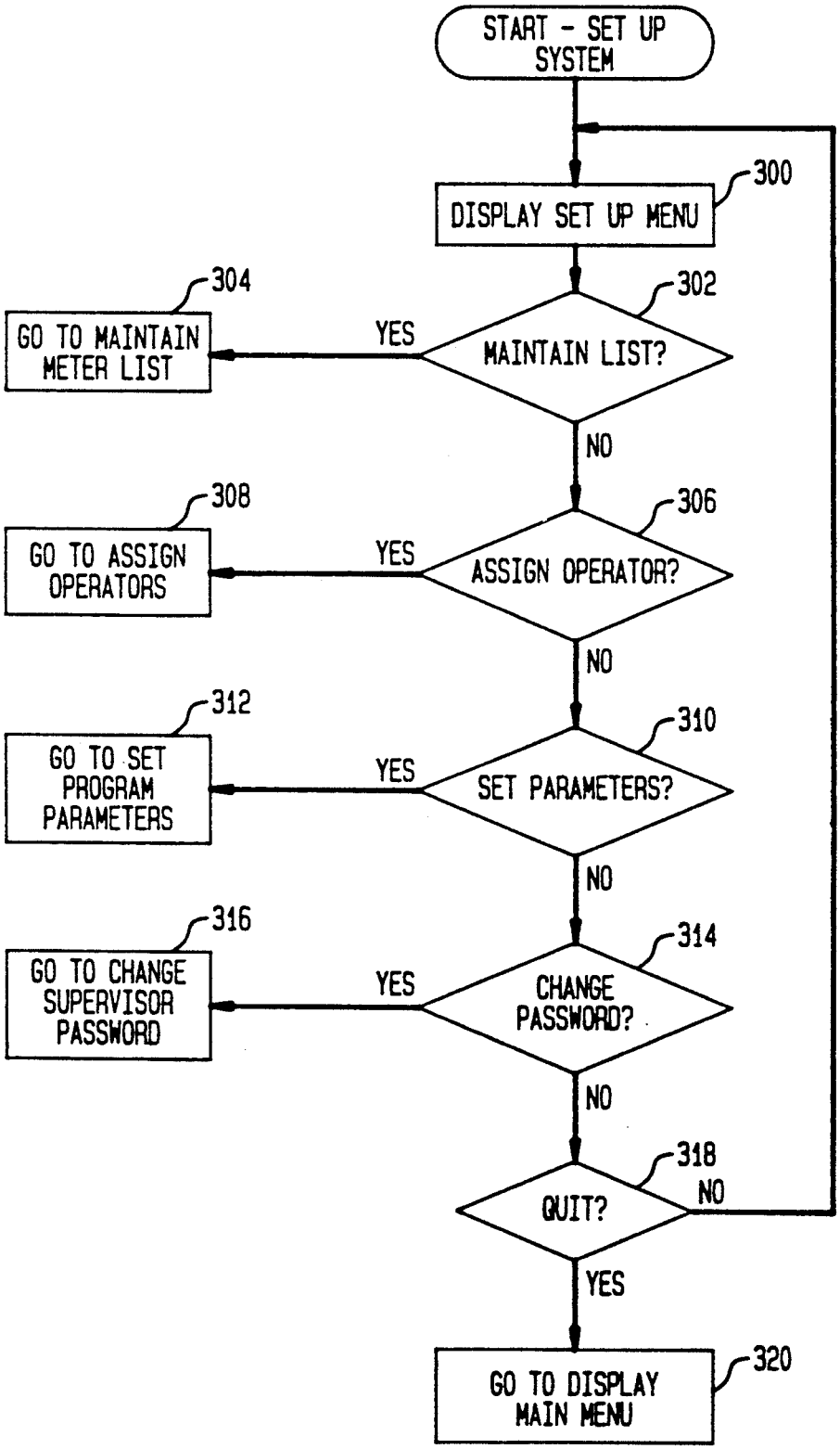
Figure 3I:
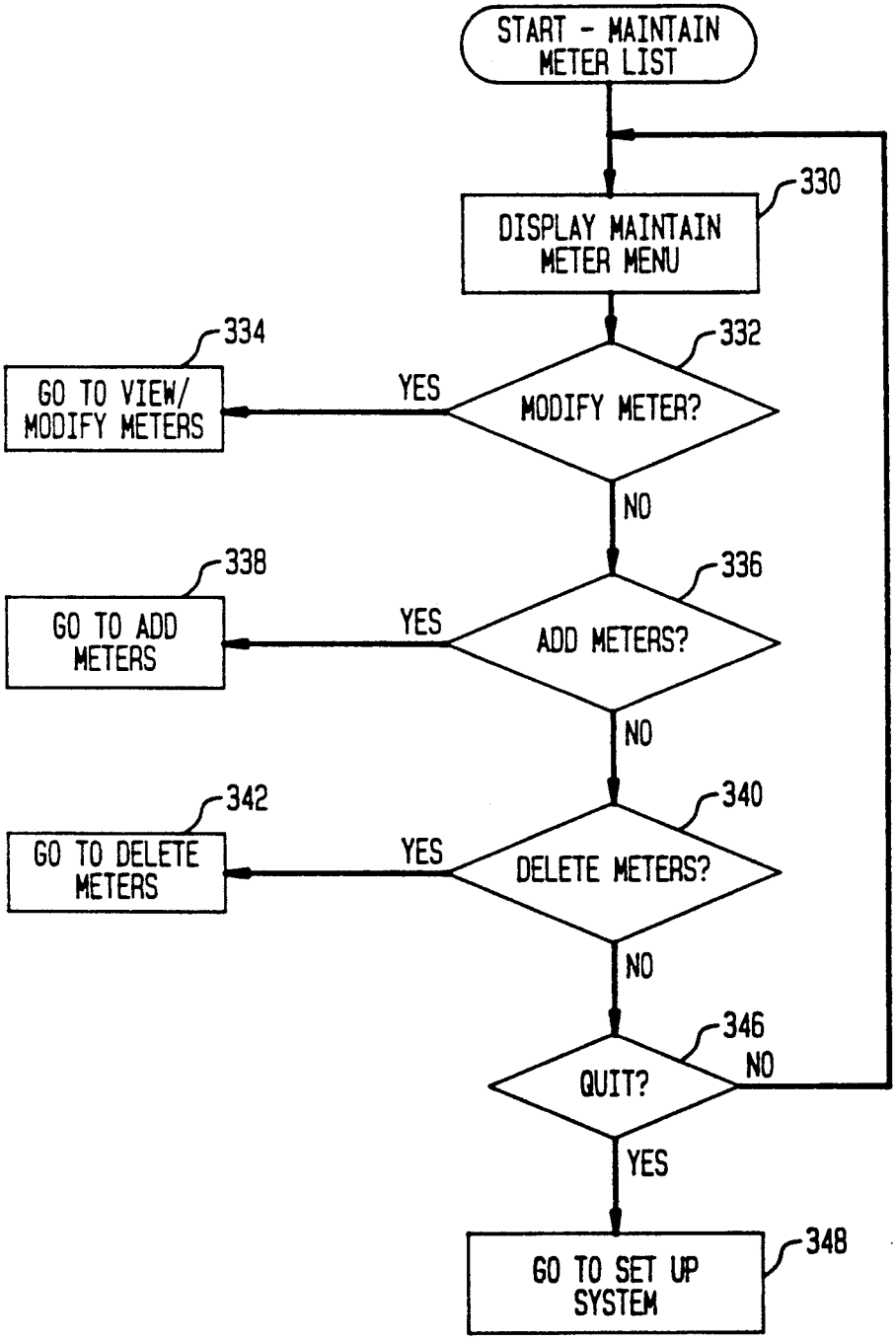
Figure 3J:
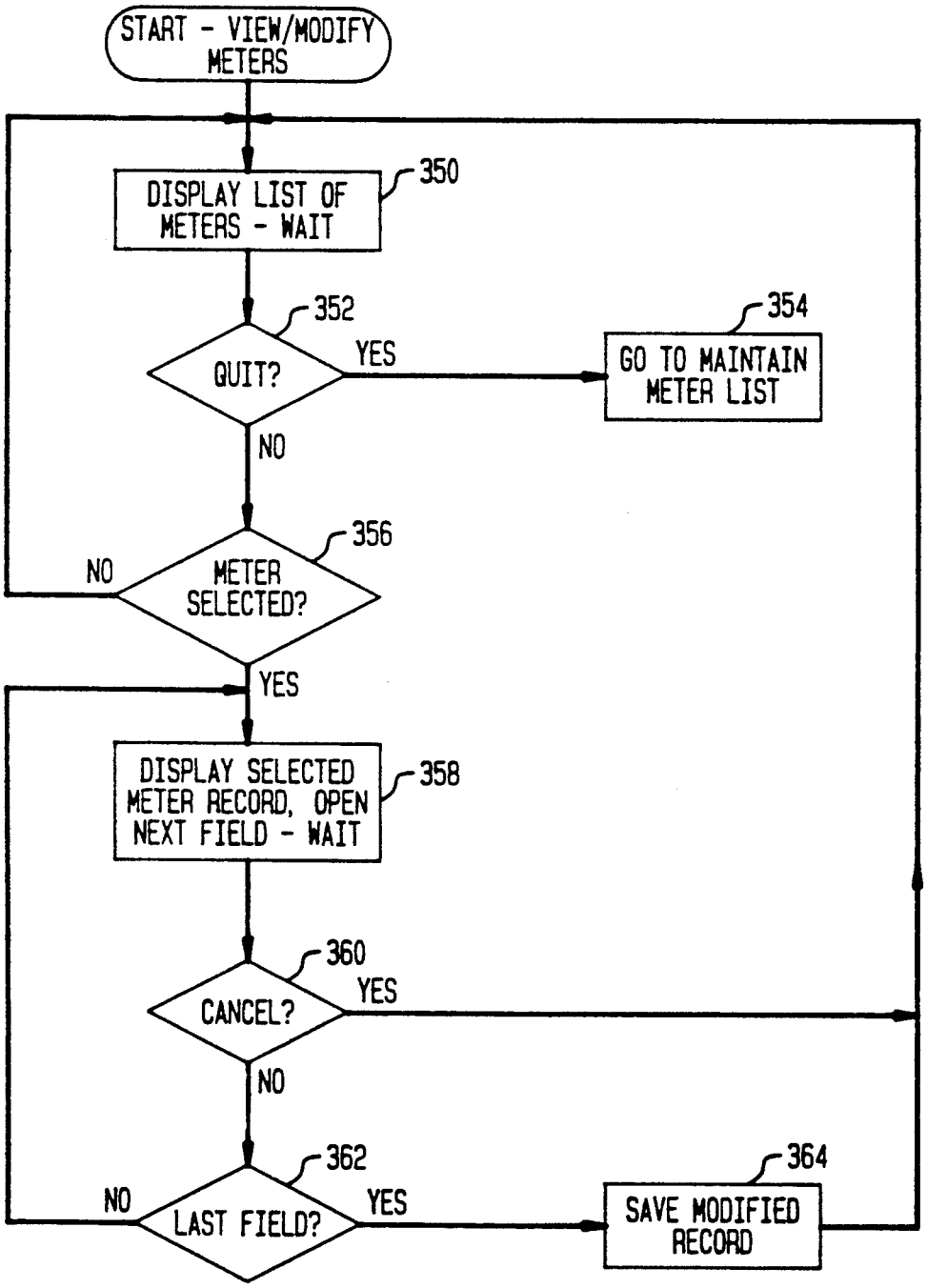
Figure 3K:
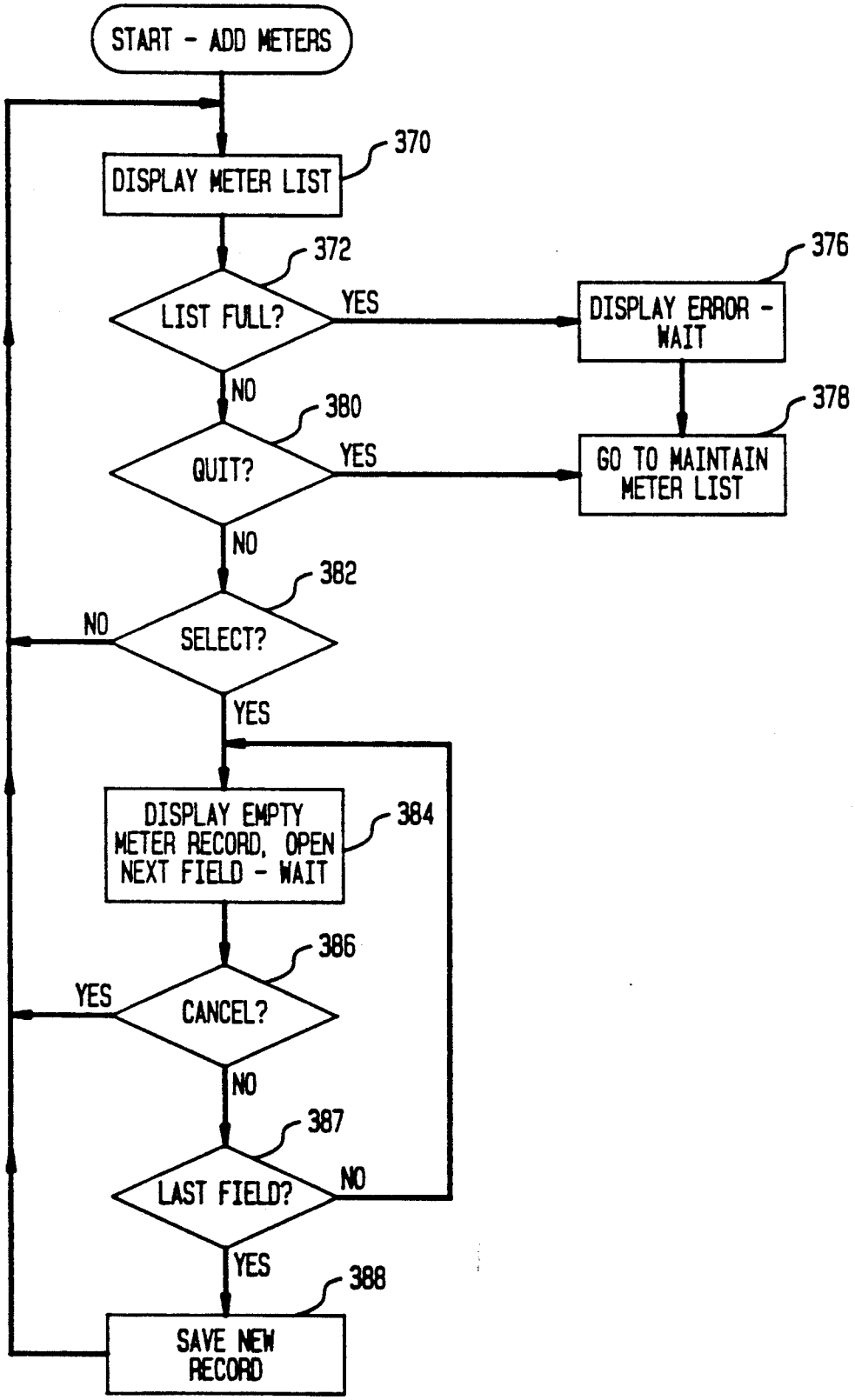
Figure 3L:
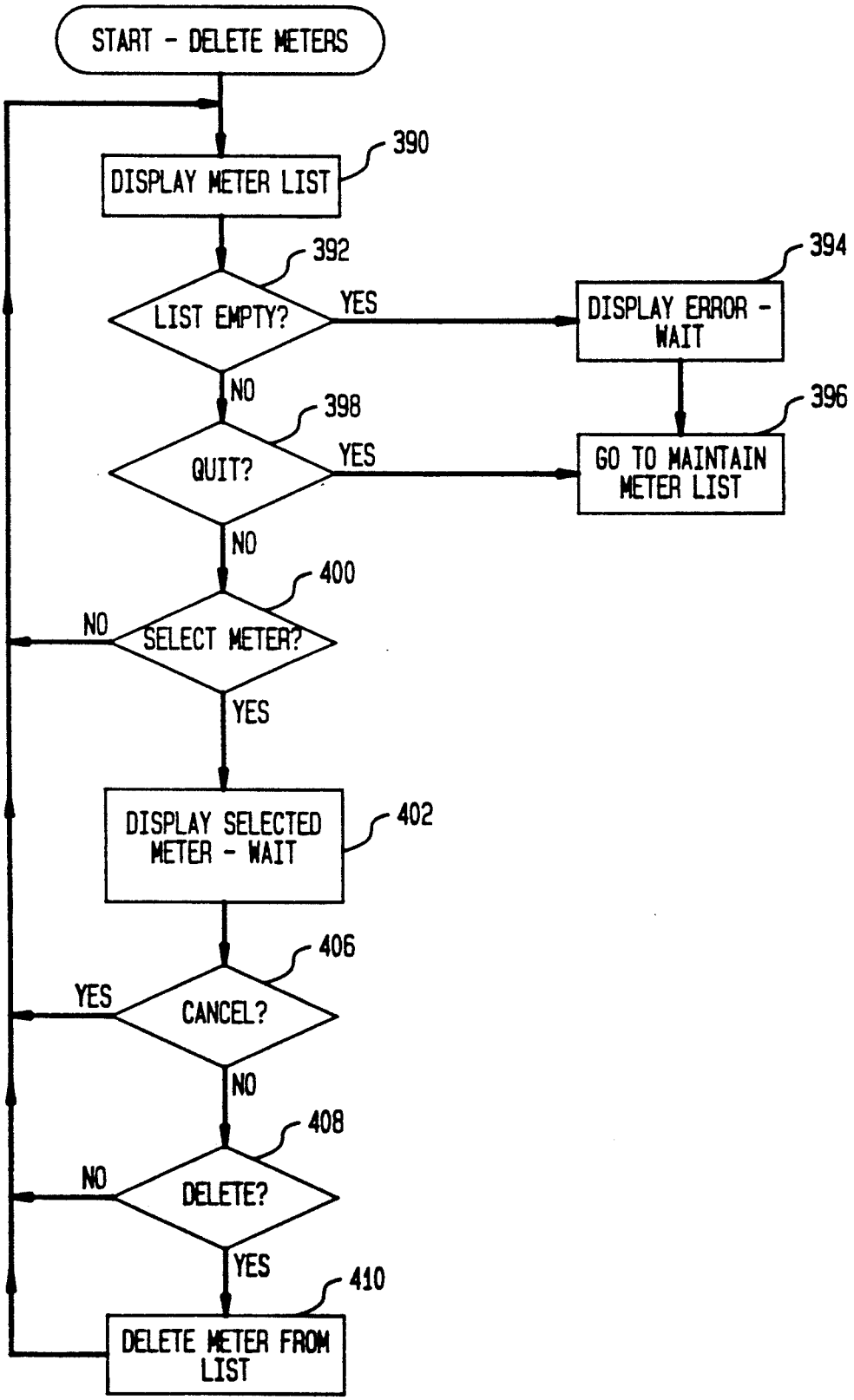
Figure 3M:
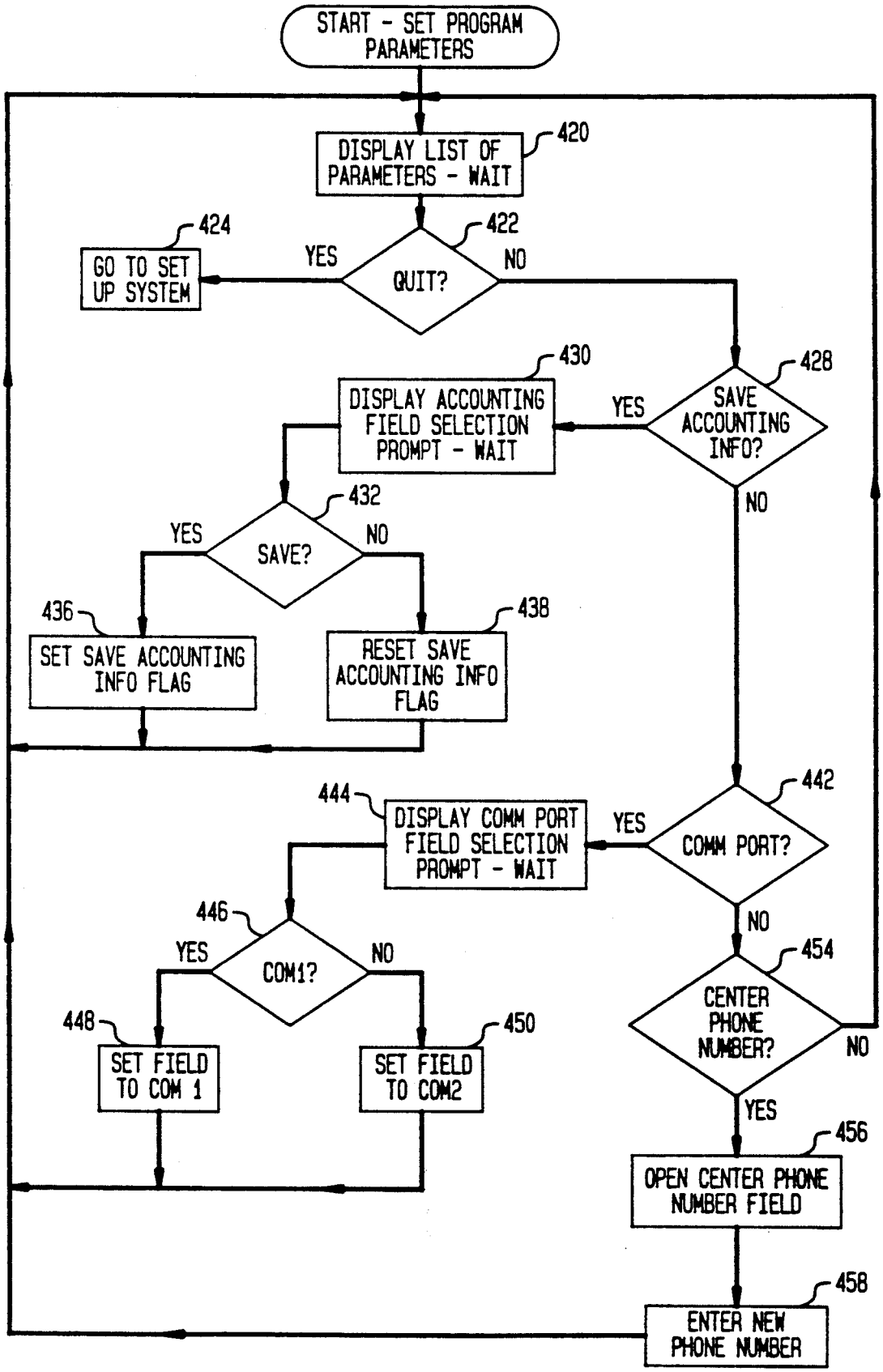
Figure 3N:
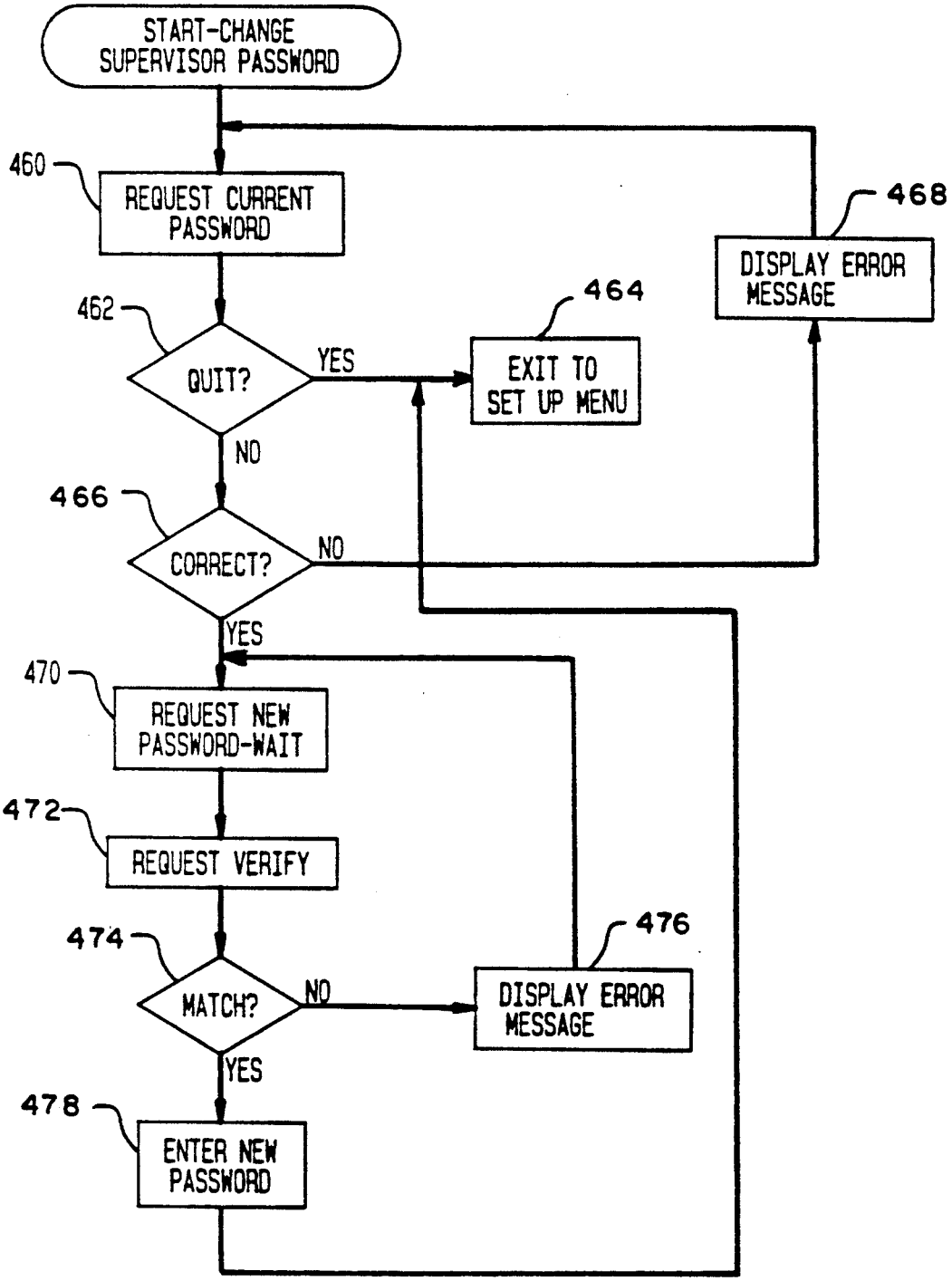

FIGS. 3*a*–3*n* show a flow chart of the operation of the systems of FIGS. 1 and 2.

DETAILS DESCRIPTION OF PREFERRED EMBODIMENTS OF THE SUBJECT INVENTION

FIG. 1 shows a schematic block diagrams of system 10 in accordance with the subject invention. System 10 includes microcomputer 12, which is preferable an IBM PC/XT/AT, or other equivalent compatible commercially available microcomputer, having at least 256K bytes of random access memory (RAM). Conventional keyboard 14 is provided for input of data by a system user and a convention CRT display 16 is provided for display of data to a system user. System 10, also includes two conventional 360K floppy diskette drives 20 for input and storage of system software and data bases, as will be described below. System 10 also includes a modem 22 for communications with remote data processing center 30. Typically, modem 22 communicates with data processing center 30 over the switched public telephone network, but communication over leased lines is also within the contemplation of the subject invention. Modem 22 will operate at 300, 1200, or 2400 baud, and preferably will be a commercially available modem manufactured by the Hayes Corporation, or other commercially available compatible equivalent.

FIG. 2 shows a schematic block diagram of another embodiment of the subject invention wherein a plurality of commercially available electronic postage meters 40*a*, 40*b*, such as the the Model 6900 Electronic Meter, marketed by the assignee of the subject invention, are attached to system 10*a* through a corresponding plurality of network interfaces, including interfaces 42*a* and 42*b*, and network controller 44 to microcomputer 12 of system 10*a*. Network controller 44 may be selected to support any of numerous commercially available local area networks, but preferably will support a wireless communications network such as a spread spectrum RF wireless local area network operating in accordance with Part 15 of the FCC regulations in the 902–928 Mhz. band. A suitable network controller is available from O'Neill Communications Inc of Princeton, N.J., and design of network interfaces 42*a* and 42*b* is a routine task easily accomplished once the network is specify by any digital systems designer of more then minimal competence. Further details of the network are not believed necessary for an understanding of the subject invention.

FIG. 3*a* shows a flow chart representation of the initial operation of system 10 or 10*a*, shown in FIG. 1 or 2, respectively. At 100 the system displays a start up screen requesting that the user input an identification code and password. (In other embodiments of the subject invention the password or both the password and identification code may be optional.) At 102 the system requests the user to input an identification code and at 104 requests input of a password. At 106 the system tests the identification code and password to determine if the user is recognized as an authorized system user. If either the identification code or the password are not recognized then at 108 the system displays an error message prompting the user to try again and waits for the user response. At 110 the system tests the user response and if the user wishes to retry loops through 102. If the user does not wish to retry, the system exits. Preferably the system will allow only a limited, predetermined number of attempts.

Assuming that both the identification code and the password are recognized, than at 112 the system displays the Main Menu and waits for user input. The Main Menu identifies three functions which the user may access: Set Up System, Obtain Account Balance, and Reset Meters. At 116 the system tests to determine if the user has requested the Set Up routine. If so the system, at 118, goes to the Set Up routine as will be described further below. Otherwise, at 120 the system tests to determine if the user has requested the Balance, and if so, at 124, goes to the Balance routine, as will be described further below. Otherwise, at 126 the system tests to determine if the user has requested the Reset routine, and if so at 128, goes to the Reset Meters routine, as will be described further below. If none of the listed functions has been requested at 130 the system tests to determine if the user wishes to quit the session, and if so exits. Otherwise, the system returns to 112 to wait for a further, appropriate response form the user.

FIGS. 3*b* and 3*c* show a flow chart representation of the operation of system 10*a* in executing the Reset Meter function.

At 134 system 10*a* displays a list of meters included in the system data base, and waits for a user response. At 136 the response is tested to determine if a Get Funds command has been entered. If that command has been entered, then at 138 system 10*a* test to determine if a meter or meters has been selected. If no meter has been selected system 10*a* returns to 134 to await appropriate input. If at least one meter has been selected then at 139 system 10*a* goes to the Get Funds routine, as shown in FIG. 3*c*, which will be described further below. Otherwise, at 140, system 10*a* tests the user response to determine if the user wishes to quit, and if so returns at 142, to display the main menu at 112 in FIG. 3*a*. Otherwise, at 144 system 10*a* tests the user response to determine if the user wishes to select a meter. If the user response is not a meter selection system 10*a* returns to 134 to await appropriate input.

If a meter has been selected, at 148 system 10*a* determines if the selected meter is connected through network controller 44. If the selected meter is not connected then at 150 system 10*a* displays a request for manual input of the access code and waits for input. If the meter is connected then at 152 system 10*a* communicates with the selected meter through network controller 44 to obtain the access code directly from the selected meter. Once the access code is obtained it is entered at 154 and at 156 a request for the recharge amount is displayed and system 10*a* waits.

The amount input is then tested at 158 to determine if the amount is less then the maximum amount as stored in the corresponding record in the system data base. If the amount is greater then the maximum then at 160 an error message is displayed and the system returns to 156. Otherwise, at 162 system 10*a* enters the amount. Then, at 164, system 10*a* request confirmation of the meter selection. At 166 the user response is tested, and if selection is confirmed, then at 168 system 10*a* records the selection of that meter for recharging. Otherwise, the meter is deselected; that is, the selection of the meter is cancelled. In either event system 10*a* returns to 134 to wait for further appropriate input.

Returning to 139, if at least one meter is selected and the user enters a Get Funds command, then at 172 system 10*a* sets up modem 22 and establishes connection with remote data processing 30. At 174 system 10*a* performs a conventional test to assure that the connection is properly established. If there is an error then at 176 an error message is displayed, and at 178 system 10*a* returns to display the meter lists (134 in FIG. 3*b*). Once satisfactory connection is established then at 180 system 10*a* accesses the meter database to obtain a unique identification code for a selected meter, and an account number for an account against which the recharge amount for that meter is to be debited. This recharge information is combined with the access code and the recharge amount for that meter to form a message, and the message is sent to remote data processing center 30. Data processing center 30 responds to the message to generate a unique recharge code as a secure function of the access code, meter identification, and recharge amount, and debits the recharge amount to the identified account. Thus, a secure recharge code is generated for that meter. (The operation of data center 30 in generating a recharge code is generally known, and further description is not believed necessary to an understanding of the subject invention.)

Then, at 182, system 10*a* transmits the message formed to data center 30 and waits for a response. At 184 system 10*a* tests for a communications error, e.g., a transmission error or failure to respond, and if a correct response is received saves the response at 186. Then, at 188 system 10*a* tests to determine if there are messages to be formed for other selected meters. If so system 10*a* returns to 180 to form a message for the next selected meter.

Returning to 184, if a communications error is detected, then at 190 system 10*a* tests to determine if predetermined retry count is exceeded, and if not, returns to 182 to retransmit the message to data center 30. If the retry count is exceeded that at 192 system 10*a* determines if there have been any previous with successful communications with data center 30 such that recharge codes have been received. If no recharge codes have been received then at 194 an error message is displayed and, at 196 system 10*a* returns to display the meter list (134 in FIG. 3*b*).

If the test at 188 shows that there has been a correct response to the last message, or the test at 192 shows that recharge codes have been received, then at 198 system 10*a* goes to the Reset Session Complete function, shown in FIG. 3*d*. Then at 200 system 10*a* tests to determine if meters are connected. If meters are connected then, at 202 system 10*a* establishes communications with a selected meter and resets that meter. Then, at 204 system 10*a* tests to determine if the reset is successful. If there is an error then at 206 an error message is displayed and the reset results are updated. Then, or if the reset test at 204 is passed, at 208 system 10*a* tests to determine if other selected meters remain to be reset, and if so returns to 202 to reset the next meter. After the last connected meter is reset, or if no meters are connected, system 10*a* goes to 210 and test to determine if a flag has been set indicating that the reset information is to be saved, and if so at 211 saves this information to a disk on disk drive 20. Then, or if the flag is not set, at 212 system 10*a* displays the reset results and waits for a user response. At 214 system 10*a* tests the user response to determine if the user wishes a receipt printed. If so, at 216 system 10*a* prints a reset receipt and returns to 212. If the user response tested at 214 is not a request for a receipt then at 218 the response is tested to determine if the user wishes to quit. If not, system 10*a* returns to 212 to wait for appropriate input. If the user wishes to quit then at 220 system 10*a* tests to determine if a reset receipt has been printed. If no receipt has been printed system 10*a* displays a print receipt prompt, at 222, and waits for user input. Then at 224 the user response is tested to determine if a receipt is requested, and if so system 10*a* goes to 216 and continues as described above. If the test 220 shows that a receipt has been printed, or the test 224 shows that no receipt is requested the reset session is completed and, at 226 system 10*a* returns to display the main menu (112 in FIG. 3*a*).

System 10, shown in FIG. 1 operates in substantially the same manner to execute the Reset Meter function, except, of course, that it need not be programmed to attempt direct communication with a meter. Instead, in system 10 the system user obtains the access code (or codes) from the selected meter (or meters) and inputs that code to system 10; then obtains the corresponding recharge code for each selected meter and enters that code through the meter keyboard.

Other functions, described below, are substantially identical in systems 10 and 10*a*, and are described with respect to system 10.

At 230 in FIG. 3*e* system 10 displays a list of accounts and requests the user to select the account or accounts for which a balance is requested, and waits for input. Then at 232 system 10 tests the user input to determine if a Get Balance has been requested. If it has at 234 system 10 tests to determine if at least one account has been selected, and if not returns to 230 to await appropriate input. If one or more accounts have been selected then at 236, system 10 goes to the Get Balance function, shown in FIG. 3*f*, as will be described below.

If the user has not requested a Get Balance function then at 238 the response is tested to determine if the user wishes to quit, and if so, at 240 system 10 goes to display the main menu (112 in FIG. 3*a*). If the user does not wish to quit then at 242 system 10 tests the response to determine if an account has been selected, and if not returns to 230.

If the user has selected an account, at 244 system 10 request confirmation, and at 246 tests the user response. If the account selection is confirmed system 10 records the selection, otherwise the account is deselected. In either event system 10 then returns to 230 to await further input.

Returning to 236 if the user has requested a Get Balance function and at least one account has been selected system 10 goes to the Get Balance function shown in FIG. 3*f*, and at 252 sets up modem 22 and establishes connection with data processing center 30. Then at 254 system 10 tests to determine if the connection with data processing center 30 is ok. If there is an error then at 256 an error message is displayed and at 258 system 10 goes to display the account list (230 in FIG. 3*e*).

If connection is satisfactorily established then at 260 system 10 accesses the data base and forms a message requesting a balance for a selected account, and at 262 transmits the message to data processing center 30 and waits for a reply at 264 system 10 tests for a communications error, e.g., a transmission error or failure to reply. If a satisfactory reply is received then at 266 the reply is saved, and at 268 system 10 test to determine if this is the last message. If not system 10 returns to 260 to form a message relating to the next selected account.

Returning to 264 if a communications error is detected then at 270 system 10 test to determine if a predetermined retry count is exceeded. If not it returns to 262 to retransmit the message to data processing center 30. If the retry account is exceeded then at 272 system 10 tests to determine if any count balances have been successfully received for other selected accounts. If no balances have been received that at 274 an error message is displayed, and at 276 system 10 goes to display the account list (230 in FIG. 3*e*).

If the test at 268 shows that there has been a successful reply to the last message, or if the test at 272 shows that account balances have been received at 278 system 10 goes to the Balance Session Complete function, shown in FIG. 3*g*.

Turning to FIG. 3*g*, at 280 the balance results are displayed, and system 10 waits for user input. At 282 the user response is tested to determine if a balance receipt is requested and, if so at 284 a receipt is printed and system 10 returns to 280. Otherwise, at 286 system 10 tests to determine if the user wish to quit and if not returns to 280 to wait for appropriate input. Otherwise, at 288 system 10 tests to determine if a balance receipt has been printed, and if not at 290 displays a prompt asking if the user wishes a balance receipt. At 292 the user response is tested and if a receipt is requested the system 10 goes to 284 and continues as above.

If the test at 288 shows that a balance receipt has been printed, or the test at 292 shows the user does not wish a receipt, at 294 the Obtain Account Balance function is complete and system 10 goes to display the main menu (112 in FIG. 3*a*).

FIG. 3*h* is a flow chart representation of the operation of system 10 in executing the Set Up System function. At 300 system 10 displays a menu of set up options and waits for input. Then at 302 system 10 tests the input to determine if the user has selected the Maintain Meter List function, and if so at 304 goes to that function. Otherwise, at 286 system 10 tests to determine if the Assign Operator function has been selected, and if so goes to that function at 308. Otherwise, at 310 system 10 tests to determine if the Set Program Parameters function has been selected, and if so at 312 goes to that function. Otherwise system 10 tests at 296 to determine if the Change Supervisor Password function has been selected, and if so, at 316 goes to that function. If no function has been selected at 318 system 10 tests to see if the user wishes to quit, and if not, returns to 300 for further, appropriate input. Otherwise, system 10 goes to display the main menu (112 in FIG. 3*a*).

FIG. 3*i* shows a flow chart representation of the operation of system 10 in executing the Maintain Meter List function, which allows the system user to modify the data base of recharge information for the plurality of meters associated with the system. This data base will contain a record for each meter associated with the system, and each record will typically contain: an account number identifying the account against which the recharge amount is to be debited, a unique (for data center 30) meter identification number, a meter name or number (not necessarily unique) by which the meter is identified to the system user, the maximum permitted recharge amount, and a default recharge amount to be used if no amount is entered by the user.

At 330 system 10 displays options for meter list maintenance and waits for user input.

At 332 system 10 tests to determine if the user has requested a View/Modify Meter function, which allows the user to modify an existing record. If so, at 334 system 10 goes to this function. Otherwise, at 336 system 10 tests to determine if the user has requested a Add Meter function, which allows a user to add a new meter to the data base, and if so goes to this function at 338. Otherwise at 340 system 10 tests to determine if the user has requested a Delete Meter function, which allows a user to delete a meter from the data base. If so system 10 goes to this function at 342. If none of the above functions have been selected, at 346 system 10 tests to determine if the user wishes to quit. If the user does not, system 10 returns to 330 for further, appropriate input. Otherwise system 10 returns to display the system set up menu (300 in FIG. 3*h*).

FIG. 3*j* shows a flow chart representation of the operation of system 10 in executing the View/Modify Meter List function. At 350 system 10 displays a list of meters and waits for user input. At 352 the user input is tested to determine if the user wishes to quit and if so system 10 goes to display the maintain meter menu (330 in FIG. 3*i*). Otherwise, at 356 system 10 test to determine if a meter has been selected, and if not returns to 350 to wait for appropriate input. If a meter is selected, then at 358 system 10 displays the selected meter record and opens the first field and waits for user input. The user may then input data to modify the open field, e.g., change the maximum recharge amount allowed for the selected meter. At 360 system 10 tests to see if the user wishes to cancel any changes which may have been made and if so returns to 350 to wait for appropriate input. Otherwise, at 362 system 10 tests to determine if the last field has been opened, and if not returns to 358 to open the next field for modification. If the last field has been opened then at 364 system 10 saves the selected record as modified and returns to 350 to wait for further input.

FIG. 3*k* shows a flow chart representation of the operation of system 10 in executing the Add Meter function. This function substantially parallels the View/Modify Meter List function described above to add a new meter to the existing list. At 370 system 10 displays a list of meters and waits for user input. At 372 system 10 determines if the meter list is full, that is if system 10 is capable of handling additional meters. If so, at 376 an error message is displayed, and at 378 system 10 goes to display the maintain meter menu (330 in FIG. 3I). Otherwise, at 380 system 10 tests the user input to determine if the user wishes to quit, and if so goes to 378 to return to display the maintain meter menu. If the user does not wish to quit at 382 system 10 tests to determine if the user has selected the position in the list where a meter is to be added. If not system 10 returns to 370 to wait for appropriate input. Otherwise, at 384 an empty meter record is displayed and the first field is opened and system 10 waits for user input to complete the record field. Then at 386 system 10 tests to determine if the user wishes to cancel the addition of a new meter and if so returns to 370 to wait for further input. Otherwise, at 387 system 10 tests to determine if the last field has been completed and if not returns to 384 to open the next field and wait for further user input. Once the test at 387 determines that the last field has been completed, then at 388 system 10 saves the new record and returns to 370 to wait for further appropriate input.

FIG. 31 shows a flow chart of the operation of system 10 in executing the Delete Meter function. At 390 system 10 displays a list of meters and waits for further input. At 392 system 10 test to determine if the meter list is empty and if so, at 394 displays an error message and at 396 goes to display the maintain meter menu (330 in FIG. 3*i*). Otherwise, at 398 the user input is tested to determine if the user wishes to quit, and if so system 10 goes to 396. Otherwise, at 400 the user input tests to determine if a meter record has been selected for deletion, and if not system 10 returns to 390 to wait for appropriate input. If a record has been selected at 402 the record is displayed and system 10 waits for user input. Then at 406 the input is tested to see if the user wishes to cancel the deletion and if so system 10 returns to 390 to wait for appropriate input. Then at 408 the input is tested further to see if the user confirms the deletion of the selected record and if not system 10 returns to 390. If the user confirms that deletion then at 410 the selected record is deleted from the meter list and system 10 returns to 490.

Preferably a meter record is selected for a modification or deletion by a highlighting it with a cursor in a known conventional manner, and meter records are added immediately before or after a highlighted record.)

Returning to FIG. 3*h*, if the Assign Operators function is selected system 10 enters a routine which functions in a manner substantially identical to the Maintain Meter List function described above, the significant difference being that the data base of system operators comprises records associated with each operator, and the records including an identification code field, and a password field. As described above the system user may View/Modify Operators, Add Operators, or Delete Operators. Further description of the Assign Operators function is not believed necessary for an understanding of the subject invention.

FIG. 3*m* shows a flow chart representation of the operation of system 10 in executing the Set Program Parameters function. System 10 displays a list of program parameters which the user may select or modify. Preferably the list will include a flag which indicates whether or not accounting information is to be saved, definition of the communications port to be used, and the remote data center telephone number. In other embodiments of the subject invention program parameters may also identify whether a printed record of recharge transactions and/or balance request is always to be printed, never to be printed, or printed at the user's option, definition of an internal or external modem, or other parameters.

At 420 system 10 displays a list of program parameters and waits for user input. At 422 system 10 determines if the user has elected to Quit, and if so at 414 goes to display the set up menu (300 in FIG. 3*h*).

Otherwise, at 428 system 10 determines if the user has selected the Save Accounting Information parameter. If the user has selected this parameter at 430 system 10 opens the save accounting information flag field displays a prompt and waits for further input. At 432 system 10 tests the user input to determine if the user has chosen to save accounting information. If the user has, at 436 the flag is set, otherwise at 438 the flag is reset, and system 10 returns to 420 to wait for further input.

If the user has not selected the Save Accounting Information parameter, then at 442 system 10 tests to determine if the Communications Port parameter is selected. If it is, at 444 system 10 opens the communications port selection field, displays a prompt and waits for further input. Then at 446 the user input is tested to determine if communications port COM1 or COM2 has been selected, sets COM1 or COM2 at 448 or 450 respectively, and then returns to 420.

If the Communication Port parameter is not selected system 10 tests at 454 to determine if the data center phone number has been selected, and if not returns to 420. If it has then at 456 system 10 opens the field for the Data Center Phone Number parameter and waits for further input, and at 458 it enters the input into the open field, then returns to 420.

FIG. 3*n* shows a flow chart representation of the operation of system lo in executing the Change Supervisor Password function. At 460 system 10 requests the user to input the current supervisor password, and at 462 system 10 test the input to determine if the user wishes to quit, and if so, at 464 goes to display the set up menu (300 in FIG. 3*h*). Otherwise, at 466 the password is tested to determine if it is correct, and if not at 468 an error message is displayed and the system returns to 460 to wait for correct input of the supervisor password. If the current password is correct then at 470 the user is prompted to enter the new password and the system waits for input. Then at 472 the user is prompted to re-enter the new password and the system again waits for input. At 474 the first and second entrys are compared and if they do not match an error message is displayed at 476 and system 10 returns to 470. If the entrys match then at 478 the supervisor password is updated, and at 464 system 10 goes to display the system set up menu.

Those skilled in the art will recognize that in the event of a fatal error condition (e.g. failure of communications with data processing center 30) well know, conventional escape, reset or time out functions are preferably provided to prevent system 10 from permanently "locking-up".

The above detailed description and the attached drawings have been provided by way of illustration only, and other embodiments of the subject invention will be apparent to those skilled in art form consideration of the above description and the attached drawings. Accordingly, limitations on the subject invention are to be found only in the claims set forth below.

What is claimed is:

1. A system for obtaining a recharge code for a selected postage meter from a data processing center, said data processing center transmitting said recharge code in response to a message from said system and debiting an amount by which said meter is to be recharged to an amount, said system comprising:

a) input means for input of data by a user of said system;

b) first communications means for communication between said system and said data processing center;

c) a memory for storing a database of recharge information relating to a plurality of postage meters; and, d) control means for:

d1) responding to identifying data input through said input means to identify one of said plurality of postage meters as said selected meter;

d2) accessing said memory to obtain recharge information for said selected postage meter;

d3) receiving access information relating to said selected meter from said selected meter;

d4) forming said message, said message including said access information and said recharge information;

d5) controlling said first communications means to transmit said message to said data processing center;

d6) receiving said recharge code from said data processing center through said first communications means, and, d7) outputting said recharge code to second communications means for transmitting said recharge code from said system to said selected meter.

2. A system as described in claim 1, wherein said control means is further for communicating with said selected postage meter through said second communications means to transmit said recharge code, whereby said selected postage meter is recharged.

3. A system as described in claim 1, further comprising a display, said control means controlling said display to display a list of said plurality of postage meters, said identifying data identifying said selected postage meter from said list.

4. A system as described in claim 1, wherein said control means is further for:

a) responding to said data to identify said at least one postage meter as said selected meter;

b) communicating with said selected postage meter to receive at least a part of said access information through said second communications means.

5. A system as described in claim 4, wherein said control means is further for communicating with said selected postage meter through said second communications means to transmit said recharge code, whereby said selected postage meter is recharged.

* * * * *